US005661907A

United States Patent [19]

Apprille, Jr.

[11] Patent Number: 5,661,907

[45] Date of Patent: Sep. 2, 1997

[54] RAZOR BLADE ASSEMBLY

[75] Inventor: Domenic Vincent Apprille, Jr., Arlington, Mass.

[73] Assignee: The Gillette Company, Boston, Mass.

[21] Appl. No.: 630,053

[22] Filed: Apr. 10, 1996

[51] Int. Cl.[6] ..... B26B 21/14

[52] U.S. Cl. ..... 30/47; 30/50; 30/57

[58] Field of Search ..... 30/47, 50, 57, 30/77, 527

[56] References Cited

U.S. PATENT DOCUMENTS

| | | | |
|---|---|---|---|
| 3,842,502 | 10/1974 | Hagan | 30/346.58 |
| 3,935,639 | 2/1976 | Terry et al. | 30/47 |
| 3,938,247 | 2/1976 | Carbonell et al. | 30/47 |
| 3,950,849 | 4/1976 | Perry | 30/47 |
| 4,026,016 | 5/1977 | Nissen | 30/47 |
| 4,200,976 | 5/1980 | Gooding | 30/47 |
| 4,270,268 | 6/1981 | Jacobson | 30/47 |
| 4,308,663 | 1/1982 | Ciaffone | 30/87 |
| 4,488,357 | 12/1984 | Jacobson | 30/57 |
| 4,492,025 | 1/1985 | Jacobson | 30/87 |
| 4,498,235 | 2/1985 | Jacobson | 30/47 |
| 4,573,266 | 3/1986 | Jacobson | 30/41 |
| 4,586,255 | 5/1986 | Jacobson | 30/41 |
| 4,587,729 | 5/1986 | Jacobson | 30/41 |
| 4,756,082 | 7/1988 | Apprille, Jr. | 30/89 |
| 4,785,534 | 11/1988 | Lazarchik | 30/50 |
| 4,831,731 | 5/1989 | Eltis | 30/50 |
| 4,932,122 | 6/1990 | Shurland et al. | 30/50 |
| 4,970,784 | 11/1990 | Althaus et al. | 30/89 |
| 5,050,301 | 9/1991 | Apprille et al. | 30/87 |
| 5,067,238 | 11/1991 | Miller et al. | 30/50 |
| 5,224,267 | 7/1993 | Simms et al. | 30/50 |
| 5,249,361 | 10/1993 | Apprille, Jr. et al. | 30/77 |
| 5,426,851 | 6/1995 | Gilder et al. | 30/50 |
| 5,546,660 | 8/1996 | Burout et al. | 30/50 |

FOREIGN PATENT DOCUMENTS

| | | | |
|---|---|---|---|
| 714122 | 8/1954 | United Kingdom . | |
| 1 460 732 | 1/1977 | United Kingdom | B26B 21/08 |
| WO 92/17322 | 10/1992 | WIPO | B26B 21/22 |
| WO 93/10946 | 6/1993 | WIPO | B26B 21/22 |
| WO 93/10947 | 6/1993 | WIPO | B26B 21/22 |
| WO 95/09071 | 4/1995 | WIPO | B26B 21/00 |

*Primary Examiner*—Hwei-Siu Payer
*Attorney, Agent, or Firm*—Edward S. Podszus

[57] ABSTRACT

A razor blade assembly for mounting on a handle via a pivotal connection, the assembly including a housing that carries three blade members, each having leading edges, and has a guard portion, a cap structure, and arcuate bearing surfaces below the blade carrying portion that pivotally engage shell bearing connections of the handle. The pivot axis of the razor blade assembly is located in a region defined by an imaginary boundary extending from the first leading edge to the second leading edge when both are in the unloaded position, extending upward and rearward from the second leading edge to a position slightly above the upper surface of the housing at a location in front of the third leading edge, extending along and slightly above the upper surface of the housing to a position in front of the first leading edge, extending downward and forward to a location within the guard portion below and forward of the first leading edge, and extending from the location within the guard portion upward and rearward to the first leading edge. The pivot axis is advantageously located at the secondary blade member leading edge and at least two of the blade member leading edges have sharpened cutting edges. The housing is provided with a cam surface engaged by a spring loaded cam follower on the razor handle, and the cam can be contoured to provide an at-rest position other than a position midway between the limit of forward and rearward arcuate travel.

44 Claims, 5 Drawing Sheets

RAZOR BLADE ASSEMBLY

BACKGROUND OF THE INVENTION

The invention relates to razor blade assemblies for mounting on handles via pivotal connections.

A well-known razor blade assembly, e.g., as shown in U.S. Pat. Nos. 4,573,266 and 4,586,255, employs a spring-biased guard member at the front of the assembly, a lubricating-strip cap potion at the back, and two spring-biased blade members between them. U.S. Pat. No. 5,249,361 shows a similar razor blade assembly with a fixed-guard. Both versions of the assembly have rails and circular surfaces for making pivotal connections with shell bearings on razor handles. Spring-biased cam followers on the razor handles interact with cam surfaces on the bottoms of the razor blade assemblies so as to bias the assemblies to neutral positions relative to the handles. During shaving, the assembly can pivot forward (clockwise) or backward (counterclockwise) from the neutral position relative to the handle, and the blades can move within the housing relative to the skin surface in order to follow the contours of the skin surface during shaving. In commercial embodiments of these razor blade assemblies (available under the Sensor and Sensor Excel trade designations from The Gillette Company), the shell bearings provide pivoting about an axis located between and above the two resiliently moving blades (considering their unloaded state as a reference). In particular, the pivot axis is located at the center of the slot in which the primary (forewardmost) blade supporting member is disposed and at the top of a clip that retains the blade members to the cartridge housing. Thus, the pivot axis is provided above the cutting edges of the blades and above the housing. This pivot axis location may therefore be referred to as being located "in the face" (that is, above the skin-engaging members) during shaving of a face. The razor blade assemblies are discarded after a number of shaves, and replacement razor blade assemblies are used with the handles containing the shell bearings and the spring-biased cam followers. The same razor handle can be used with both versions of the razor blade assembly, because they both have the same size rails and circular surfaces.

SUMMARY OF THE INVENTION

It is desired to improve shaving performance by providing three blades within a cartridge. However, simply accommodating a third blade in a widened conventional twin blade cartridge housing, which also supports skin-engaging guard and cap surfaces, results in a geometric interference between the shell bearings of the handle and the cartridge housing as the cartridge rotates in response to shaving forces.

In one aspect, the invention features, in general, a razor blade assembly for mounting on a handle via a pivotal connection. The razor blade assembly includes a housing that carries three blade members, each having a leading edge, and has a guard portion at the front, a cap structure at the rear, a blade member mounting portion between the guard portion and the cap structure, top surfaces at the sides of the blade member mounting portion, and arcuate bearing surfaces below the blade member mounting portion that slidably engage surfaces of the pivotal connecting structure of the handle. The arcuate surfaces have radii of curvature so as to provide pivotal mounting on the handle about a pivot axis that is located in a region defined by an imaginary boundary extending from the leading edge of the first blade member to the leading edge of the second blade member when both are in the unloaded condition (which corresponds to the raised at-rest position, assuming resiliently mounted blade members), extending upward and rearward from the second leading edge to slightly above the upper surface of the housing at a location in front of the leading edge of the third blade member, extending along and slightly above the upper surface of the housing to a position in front of the first leading edge, extending downward and forward to a location within the guard portion below and forward of the leading edge of the first blade member, and extending from the location within the guard portion upward and rearward to the first leading edge. So locating the pivot axis permits three blade members to be accommodated while still maintaining good shave characteristics.

In preferred embodiments the cap structure has a lubricious shaving aid received in a cavity at the rear of the housing, and the pivot axis is located on the skin surface during shaving (preferably near the leading edge of the middle blade member) so that the blade assembly can rotate, via the arcuate bearing surfaces engaging shell bearings on the razor handle, through a desired arc of travel of up to about 45° without the shell bearings impinging into the housing, particularly avoiding an interference in the region of the shaving aid. The housing has clips at the ends of the housing that retain the blade members on the housing. At least two of the blade members have leading edges that are sharpened cutting edges. The blade members have blade cutting edge members mounted on an L-shaped base and platform member. The blade members are mounted in the housing for resilient movement during shaving. The arcuate bearing surfaces have a constant radius of curvature. The guard member has upwardly extending ribs with tips located above a plane passing through the leading edges. Shaving forces are balanced equally over the cutting edges by locating the pivot axis at a plane through two of the cutting edges and close to the midpoint between skin-engaging surfaces of the cap and guard.

In another aspect, the invention features, in general, a razor blade assembly for mounting on a handle having a pivotal connecting structure and a spring-biased cam follower. The razor blade assembly includes a housing having a guard portion at the front, a cap portion at the rear, a blade member mounting portion between the guard portion and the cap portion, and structure that mates with the handle pivotal connecting structure so that the housing moves through an arc between a forward pivot stop position and a rearward pivot stop position. The housing also has a cam surface with an apex that is located to provide an at-rest position other than a position midway between the forward pivot stop position and the rearward pivot stop position. The apex can be located near the front of the housing to cause the assembly to be biased upward (also referred to as "forward") on the razor handle, whereby the arcuate undersurface of the cartridge is brought to the forward pivot stop position, so that the cap contacts the skin first and then shaving forces orient the cartridge, and provides low initial angles of attack of the blade. Alternatively the apex can be located near the rear of the housing so that the assembly is biased downward (also referred to as "rearward") on the razor handle, whereby the arcuate undersurface of the cartridge is brought to the rear pivot stop position, so that a higher initial angle of attack of the blades is provided and the guard contacts the skin first. The apex can also be provided at a locations providing both forward and rearward pivoting but to different extents in the two directions.

Other advantages and features of the invention will be apparent from the following description of preferred embodiments thereof and from the claims.

DESCRIPTION OF THE PREFERRED EMBODIMENTS

Figure 1:
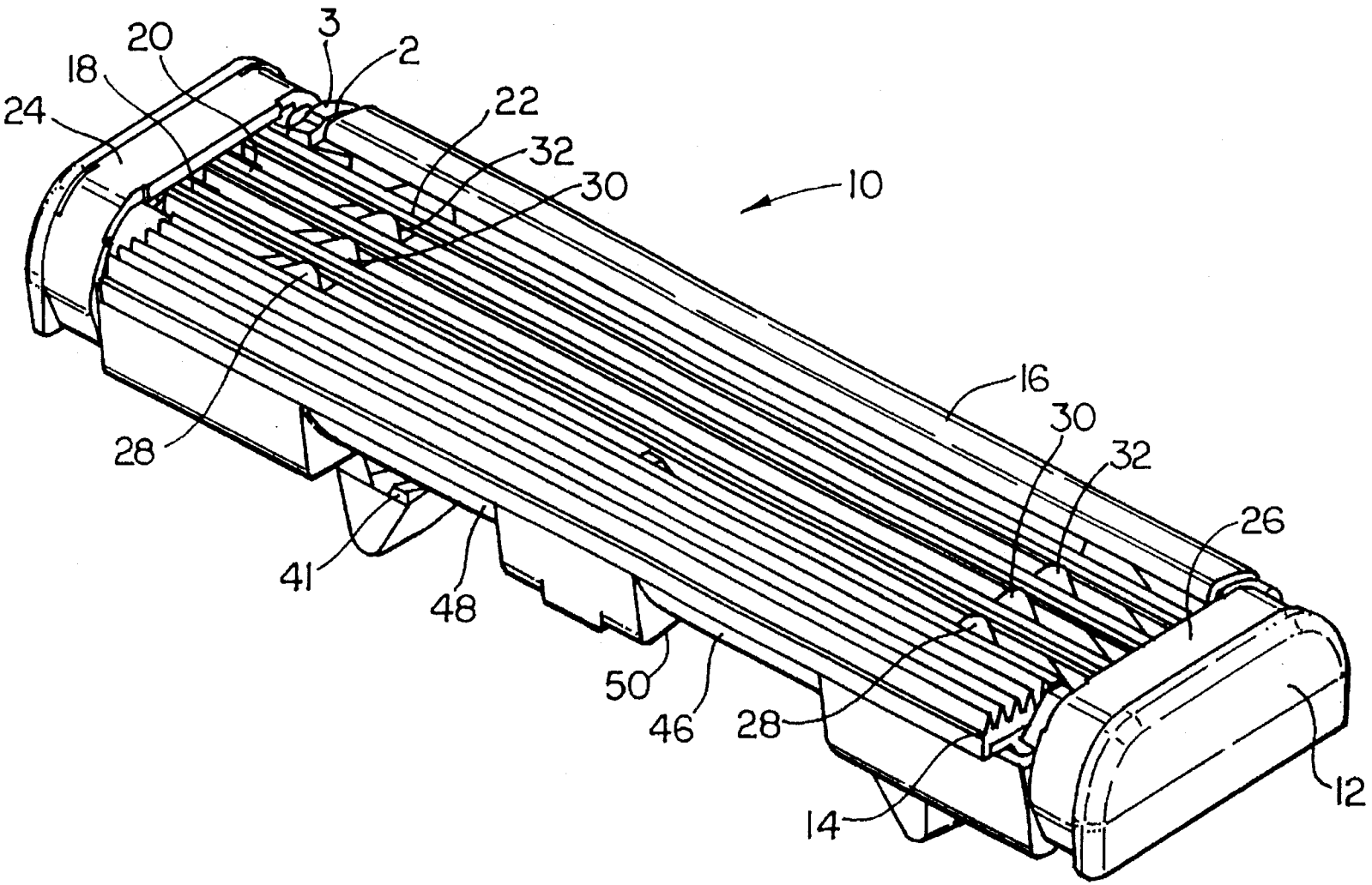
FIG. 1 is a perspective view of a razor blade assembly according to the invention.
Figure 2:
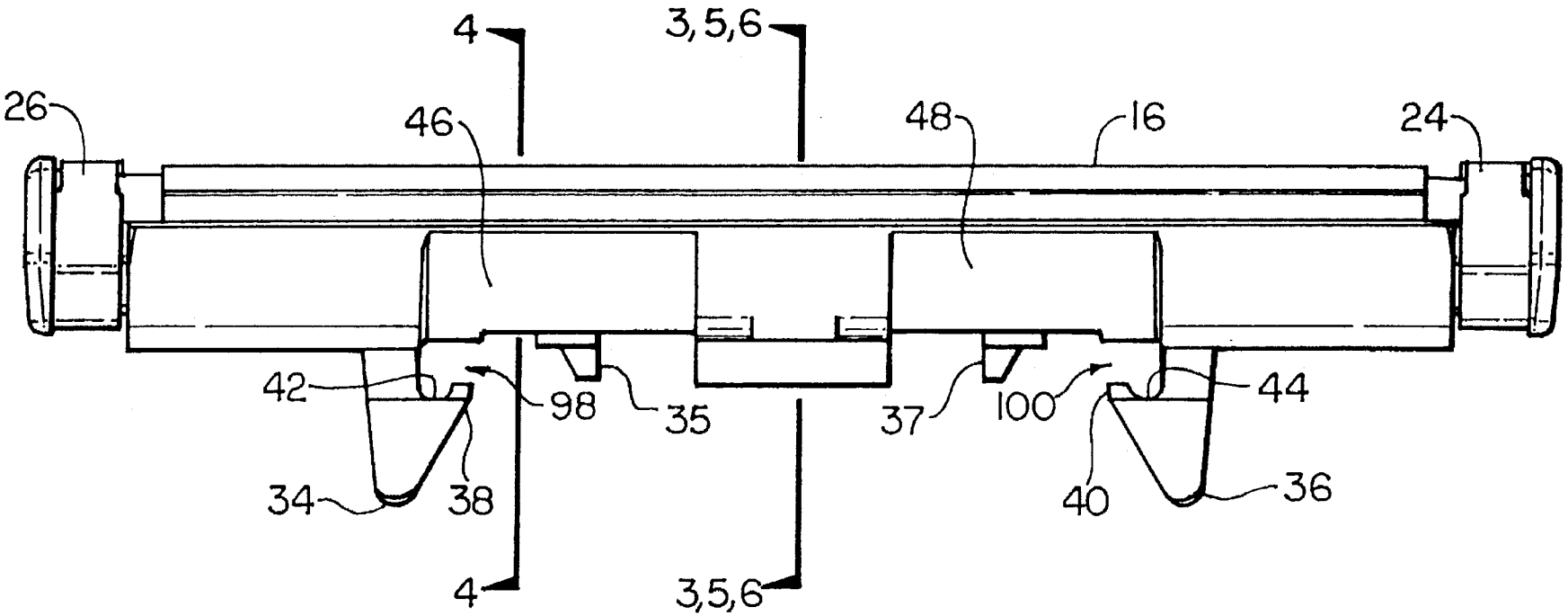
FIG. 2 is a rear elevation of the FIG. 1 razor blade assembly.
Figure 3:
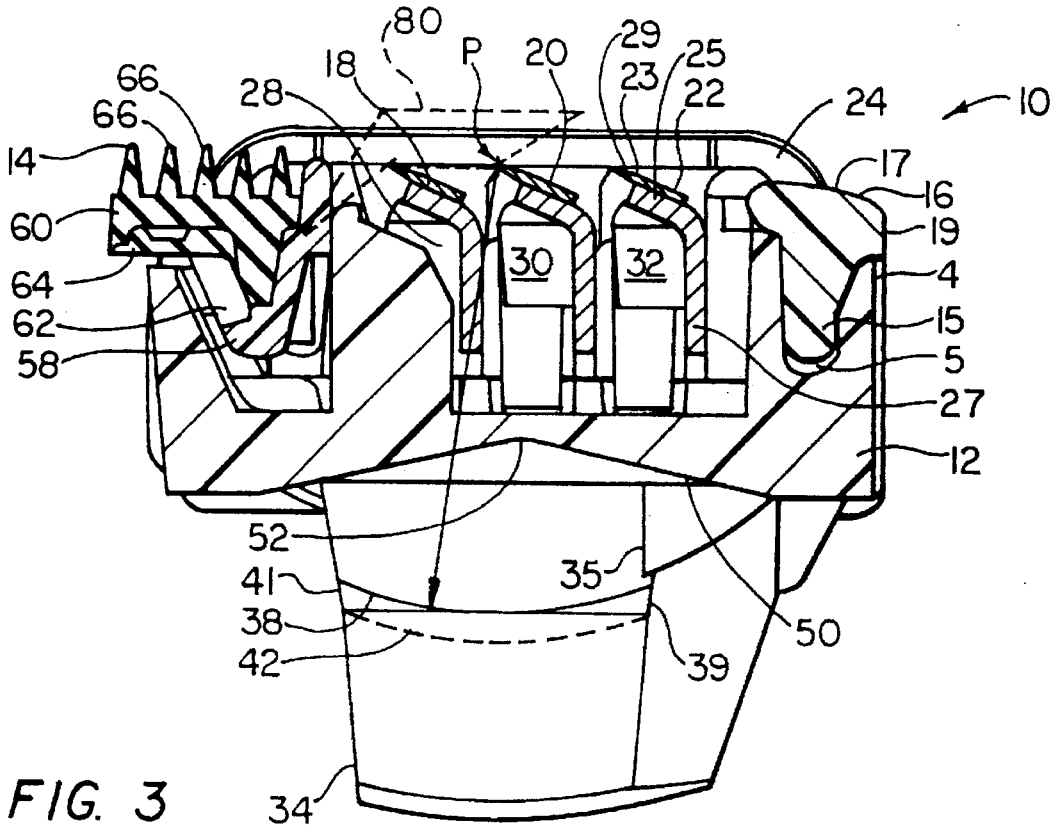
FIG. 3 is a vertical partial sectional view, taken at 3—3 of FIG. 2, of the FIG. 1 razor blade assembly.

Referring to FIGS. 1–3, there is shown razor blade assembly 10 for mounting on a handle having a pivotal connecting structure as described in U.S. Pat. No. 4,573,266. Razor blade assembly 10 includes plastic housing 12, guard member 14 at the front of housing 12, cap member 2 at the rear of the housing 12 and having disposed therein lubricating strip cap member 16 at the rear of housing 12, and three blade members 18, 20 and 22 in a blade mounting portion of housing 12 between guard member 14 and lubricating cap member 16. Primary blade 18 is nearest the guard, secondary blade 20 is next nearest the guard, and tertiary blade 22 is furthest from the guard. The cap member 2 has an upper surface portion 3 and a rear surface portion 4. The cap member 2 is provided with an elongated cavity 5 defined in part by the upper surface portion 3 and the rear surface portion 4. Lubricating cap member 16 has a base 15 received in the cavity 5 at the rear of housing 12. Lubricating cap member 16 has a top surface 17 blending into a rear surface 19 to generally form a continuation of the cap member upper and rear surface portions. Blades 18, 20, 22 each include a separate leading edge carrying portion 23 that is supported on an L-shaped member having a platform 25 and a base portion 27. Each leading edge carrying portion 23 has a respective leading edge 29 generally directed towards the guard member 14. The leading edges 29 can be formed as sharpened cutting edges. Metal clips 24, 26 at the two sides of housing 12 retain the ends of blades 18, 20, and 22. Blade members 18, 20, 22 could be formed fixed in the housing 12, but preferably they are resiliently mounted, and are biased to their raised, at-rest positions (that is, not loaded by shaving forces) shown in FIG. 1 via plastic leaf-spring arms 28, 30, 32 that are integral with plastic housing 12 and extend in from both sides thereof.

Guard 14 is a unitary molded member formed of bottom base portion 58, of rigid plastic, and upper portion 60 of elastomeric material. Bottom base portion 58 has a substantially V-shaped cross sectional portion 62 and a forwardly projecting platform portion 64 which has a plurality of openings spaced along its length. Upper portion 60 is molded contiguous to base portion 58 and is made of a thermo-plastic elastomeric material chosen to provide flexibility for ribs 66, as is described in detail in U.S. Pat. No. 5,249,361, which is hereby incorporated by reference. The tips of ribs 66 are in a plane that is about half-way between the plane that passes through the cutting edges of the blade members and the top of clips 24, 26. The raised tips provide effective shielding of the blades. The tips also exert a traction force on the skin to stretch it and raise hairs before the primary blade, thus reducing overall cutting effort.

It is desirable to provide three blade members to provide more closeness and control over shaving performance by providing a greater degree of precision adjustment in determining the shaving geometry, for example, different blade exposures can be set, or different spans set between groups of two adjacent elements that contact the skin, as described in detail in PCT Publication WO 95/09071, which is hereby incorporated by reference for disclosure of shaving geometry. However, simply adding a third blade could disadvantageously increase drag forces, which is believed due to the cutting force being applied to more blades. It is desirable that the housing 12 be large enough to accommodate not only the three blade members, but also the above-described guard 14 with elastomeric fins 66 and lubricating cap member 16 to reduce the drag forces.

Referring to FIG. 2, extensions 34, 36 are located at the bottom of housing 12 and carry inwardly extending opposed curved rails 38, 40 having respective curved surfaces 42, 44. The undersurfaces 46, 48 of housing 12 are similarly curved and provide, with extensions 34, 36, a pivotal connecting structure that mates with components on the handle, as is described in detail in U.S. Pat. Nos. 4,488,357; 4,498,235; 4,492,025; 4,573,266; 4,586,255, 4,756,082 which are hereby incorporated by reference for disclosure of shell bearing connections between a razor blade assembly and a handle.

Figure 4:
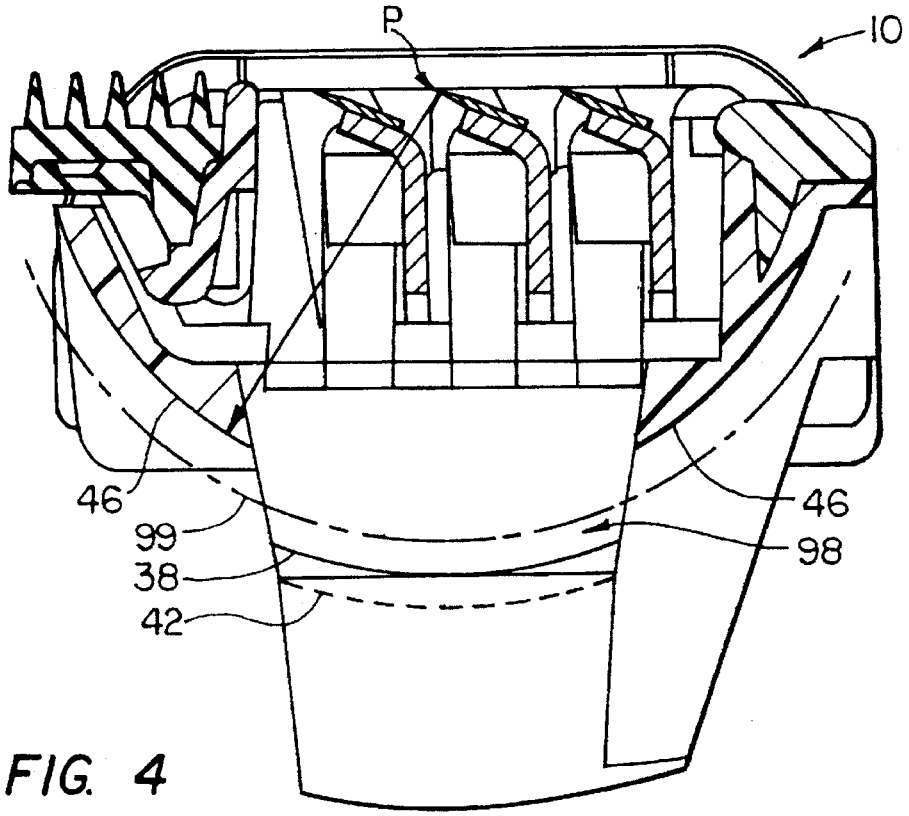
FIG. 4 is a vertical partial sectional view, taken at 4—4 of FIG. 2, of the FIG. 1 razor blade assembly.

Referring to FIGS. 2, 3 and 4, it will be seen that the blade assembly rails 38, 40, in conjunction with undersurfaces 46, 48 of housing 12 define arcuate slots 98, 100 adapted to receive razor handle shell bearings (not shown). Referring to FIG. 4, arcuate slot 98 disposed tangent between curved undersurface 46 and curved rail 38 is shown with extended centerline 99 extending therefrom. The shell bearings comprise a pivot mounting structure adapted to cooperate with the above described blade assembly pivot mounting structure to facilitate pivotal connection of the blade assembly to the razor handle assembly.

The mating structure on the handle shell bearing (not shown) has stop surfaces that prevent, as best seen in FIGS. 1 and 3, rear extension surface 39 from further "upward" travel to provide a forward pivot stop position and front extension surface 41 from further "downward" travel to provide a rearward pivot stop position. As best seen in FIGS. 2 and 3, the shell bearings on the handle (not shown) have recesses that mate with stop surfaces 35, 37 formed on the respective curved undersurfaces 46, 48 to complement the rearward pivot stop position to prevent further "downward" travel.

As is indicated in FIGS. 3 and 4, the top surfaces of rails 38, 40 and housing undersurfaces 46, 48 have radii of curvature about pivot axis P located at the cutting edge of the second blade 20. The curved surfaces 42, 44 of extensions 34, 36 are similarly curved about the pivot axis P. The top curved surfaces of the rails 38, 40 have radii of curvature of 0.2291" (5.82 mm), shown by the arrow extending from pivot axis P in FIG. 3, and the undersurfaces 46, 48 have radii of curvature of 0.1921" (4.88 mm), shown by the arrow extending from pivot axis P in FIG. 4, which are the same dimensions that the corresponding surfaces have in the prior commercially available Sensor razor blade assembly. Use of the same radius permits razor blade assembly 10 to be used with existing Sensor handles, a large number of which have already been purchased by the consuming public, even though the blade member mounting portion is extended substantially in width from front to rear to accommodate the third blade member. The substantially widened blade member mounting portion results from the presence of the additional blade member, where the blade members are positioned with an inter-blade span or spacing that is typical to that on conventional Sensor-type cartridges. The provision of three blade members advantageously permits the span between pairs of adjacent blade members to be set differently, as described in detail in PCT Publication WO 95/09071, which is hereby incorporated by reference for disclosure of shaving geometry. The inter-blade span common for resiliently moving blades is between 0.5 mm and 2.0 mm, and typically about 1.5 mm. The larger blade member mounting portion of assembly 10 has the effect of pushing back the lubricating strip cap member in order to conveniently accommodate it on the cartridge and causing it to occupy a region that would otherwise be occupied by the arcuate surfaces of the pivotal connection of existing two-blade assemblies, and in particular giving rise to an interference with the shell bearings of the razor handle if the cartridge were rotated through the typical about 40° to 45° arc of rotation permitted with a Sensor-type cartridge. The larger blade member mounting region is accommodated, while maintaining the lubricating strip cap member and the same radius of curvature, by lowering the pivot axis from the top of the clips between the two blades (as in the existing two-blade structures taken as a reference) to the cutting edge of the middle blade member, and still maintaining a permissible overall rotation through an arc of up to about 45° without a geometric interference arising.

Still referring to FIG. 3, cam surface 50 is formed in the bottom of housing 12. Surface 50 has two oppositely inclined surfaces of the same size and an apex 52 located at a position midway between the front and the back of cam surface 50. Cam surface 50 permits assembly 10 to pivot forward or rearward to the same extent during shaving, and is adapted to receive a cam follower to bias the cartridge within the range of overall rotation through a 40° to 45° arc.

Figure 5:
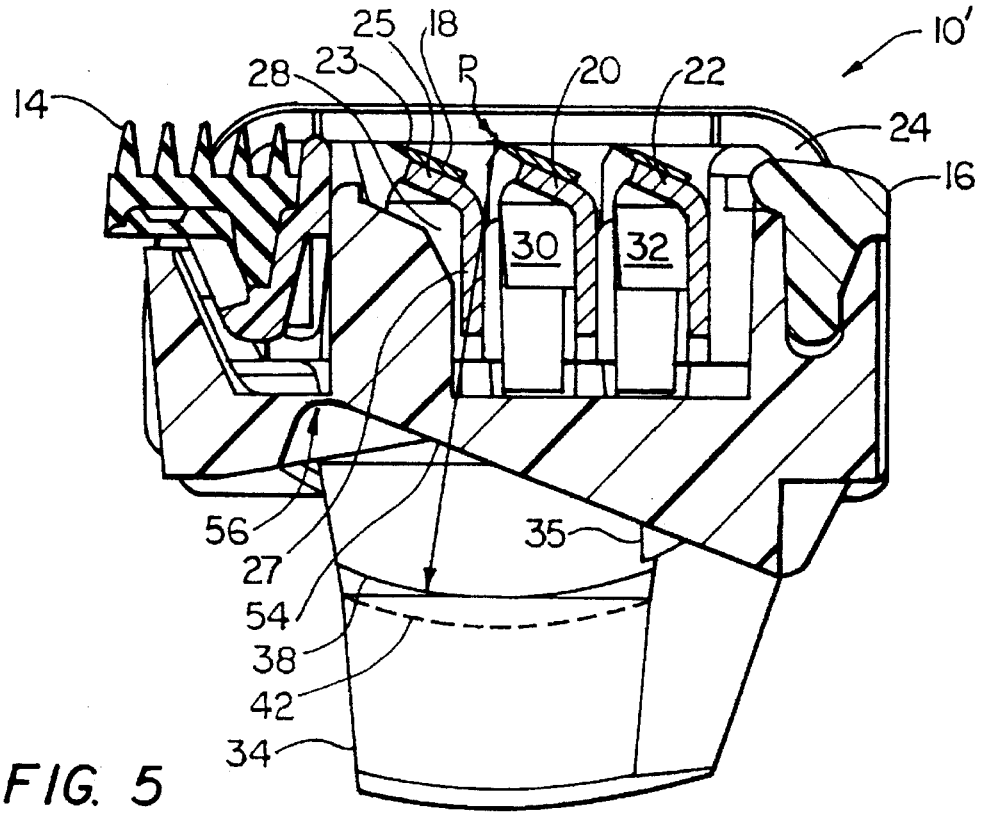
FIG. 5 is a vertical partial sectional view, taken at 5—5 of FIG. 2, of an alternative embodiment of the FIG. 1 razor blade assembly.

Referring to FIG. 5, razor blade assembly 10' has a cam surface 54 with apex 56 located at the front end thereof but otherwise has the same structure as assembly 10. Cam surface 54 is contoured so that cam follower 70 is compressed to the same extent that it is compressed when it follows cam surface 50 of the FIG. 3 embodiment in both the at-rest position and the fully pivoted stop position along the arc of rotation. Because the cam follower is spring-loaded, there is a similar restoring force on the cartridge of the embodiments of FIGS. 3 or 5 at their respective initial and fully rotated positions.

Figure 8:
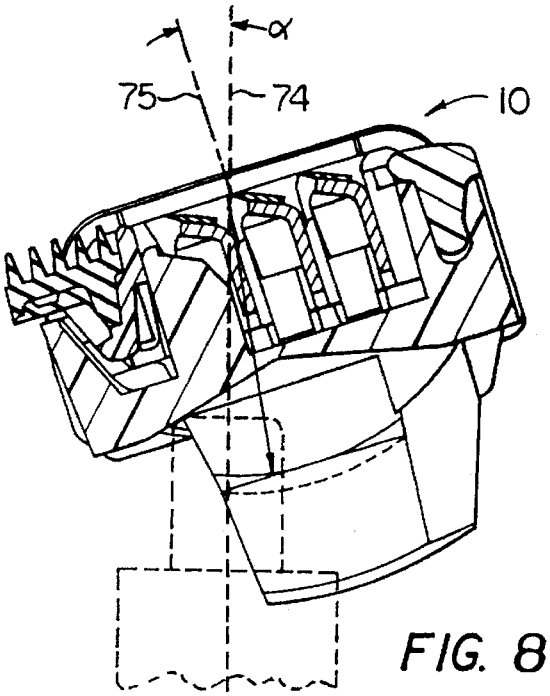
FIG. 8 is a vertical sectional view of the FIG. 7 razor blade assembly and handle with the razor blade assembly shown in a pivoted position.
Figure 9:
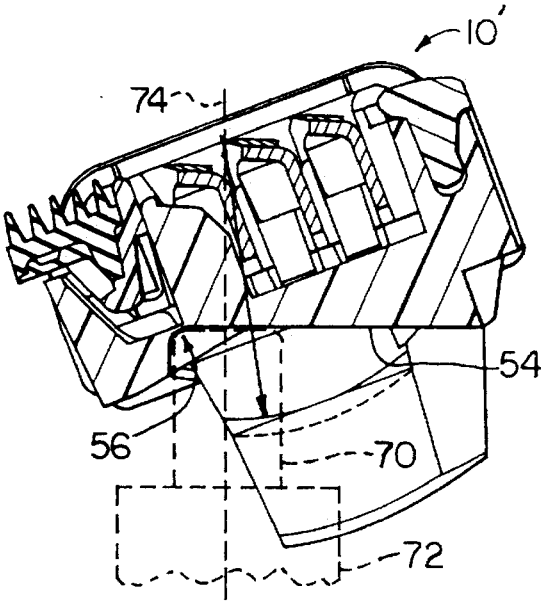
FIG. 9 is a vertical sectional view of the FIG. 5 razor blade assembly with portions of a handle and its cam follower shown in phantom in an at rest position.
Figure 10:
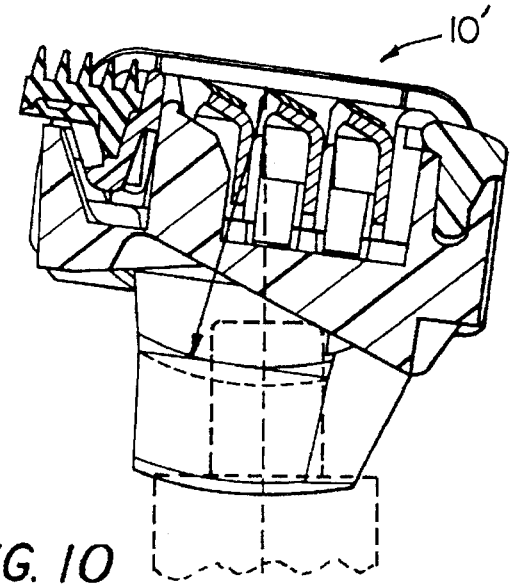
FIG. 10 is a vertical sectional view of the FIG. 9 razor blade assembly and handle with the razor blade assembly shown in a pivoted position.

Referring to FIGS. 7–10, FIGS. 7 and 9 show the at-rest positions for razor blade assemblies 10, 10', and FIGS. 8 and 10 show their respective pivoted positions that can result during shaving. The distance from the cam surface 54 to the shell bearing at the at-rest position or at the fully rotated position is the same as that from the cam surface 50. At the at-rest position, the distance from the pivot axis P to the location of tangency of the cam follower 70 on the cam surface 54 is the same as that distance to the location of tangency of cam follower 70 on cam surface 50. At the fully rotated position, the cam surface 54 at the location of tangency of the cam follower 70 is displaced in vertical distance relative to the location of tangency at the at-rest position by the same amount as at the same location on the cam surface 50 tangent to cam follower 70.

For razor blade assembly 10 (FIG. 7), the at-rest position is a neutral position; in this position a plane through the cutting edges is perpendicular to axis 74 along which cam follower 70 slides. In the at-rest position, spring-biased cam follower 70 rests at apex 52 in the position in which the follower is most extended from handle 72. Assembly 10 can be rotated forward ("upward") or rearward ("downward") from this at-rest position.

FIG. 8 shows razor blade assembly 10 pivoted upward (counter clockwise in FIG. 6) to a forward position which could result from downward forces primarily on guard 14 during a shaving operation. Reference axis 75 constructed through the pivot axis perpendicular to the blade assembly 10 has been pivoted relative to reference axis 74 through an arc of rotation $\propto$ of about 22.5°.

Referring to FIG. 9, razor blade assembly 10' is tilted forward ("upwardly-biased") in its at rest position, with spring-biased cam follower 70 resting at apex 56 in the position in which the follower is most extended from handle 72. Assembly 10' can only be rotated downward (clockwise in FIG. 9) to a rearward position from this at-rest position, as is shown in FIG. 10, and cannot be rotated forward ("upward"). The upwardly-biased orientation presents a lower effective angle of attack of the blades initially, to provide more initial comfort and less likelihood of nicking the skin being shaved.

During shaving, blade members 18, 20, 22 are independently resiliently movable with respect to housing 12, and housing 12 pivots with respect to handle 72 with the result that the cutting edges tend to follow the contours of the skin surface. All three blade members can have sharp curing edges to cut body or facial hairs at three locations. Furthermore, it may be advantageous to set the blades to have different exposures, e.g. increasing exposure progressing from the primary blade to the tertiary blade, as is described in PCT Publication WO 95/09071, which is hereby incorporated by reference. Alternatively, one of the blades, e.g. the secondary or tertiary one, could be formed with a relatively narrow blunt edge designed to not penetrate hairs, as is described in detail in PCT Publication WO 92/17322, which is hereby incorporated by reference. Also alternatively, one of the blades, e.g., the primary or secondary one, could be formed dull to act solely as a resiliently movable guard.

The pivot axis P is in a preferred embodiment at the cutting edge of the secondary blade. When the pivot axis P is located at the level of a skin engaging member such as the blade cutting edge, the pivot axis P is then located on the skin surface during shaving. During shaving, housing 12 pivots about pivot axis P, which is desirably located at the skin surface, thereby avoiding chatter of the blades and providing effective tracking of the three blades on the face or skin surfaces being shaved, while permitting the blade assembly 10 to rotate via the arcuate slots 98, 100 engaging shell bearings on the razor handle through a desired arc of motion of up to about 40° to 45°. In particular, when razor blade assembly 10 is thus rotated, for example, through slot 98 relative to a fixed arcuate surface extending along centerline 99 shown in FIG. 4, the housing 12 does not intersect, in the sense of giving rise to a geometric interference, the arcuate surface. Having the virtual pivot axis P at or into the face (assuming the face is the surface being shaved) causes the cutting edges to in effect be dragged across the face (as opposed to being pushed into the face) in order to avoid nicks. Advantageously the pivot axis P is not rearward of the tertiary blade and into the face, in order to avoid in effect pushing all the blades into the face, which is less likely to avoid nicks.

Pivot axis P could also be moved forward of the cutting edge of the second blade member to the cutting edge of the first blade member and could be located at positions above these two blade members up to slightly above the upper surface of the housing so long as the blade assembly 10 rotates on the arcuate slots 98, 100 engaging shell bearings on the razor handle through a desired arc of motion, e.g. through up to about 40° to 45°, without the shell bearings (which extend along an imaginary arcuate surface extending from the arcuate slots 98, 100) impinging on the housing 12, particularly on the cap member 2 in a region of the lubricating strip cap member 16, or other necessary structures. If the lubricating strip cap member 16 were moved or changed in shape, e.g. by being made very thin, a pivot axis higher relative to the blades could be employed. The pivot axis could also be moved to a lower position in front of the first blade (to a location within the guard member). In general, the pivot axis should be located in a region defined by boundary 80 shown on FIG. 3 in dashed lines so long as the radius of curvature is maintained without interfering with necessary structures. Boundary 80 extends from the first cutting edge to the second cutting edge (when both are in the raised position shown in FIG. 3), extends upward and rearward from the second cutting edge to slightly above the upper surface of the housing at a location in front of the third cutting edge, extends along (and slightly above) the upper surface of the housing to a position in front of the first blade member, extends downward and forward to a location within the guard member below and forward of the first cutting edge, and extends from the location within the guard portion upward and rearward to the first cutting edge. As indicated in FIGS. 3 and 4, and discussed hereinabove, the arcuate surfaces of the housing 12 such as rails 38, 40 and undersurfaces 46, 48 are formed having radii of curvature about any chosen pivot axis P location as their center, whereas the numerical value of the radius of curvature of each respective arcuate surface is maintained the same.

In order to obtain relatively equally balanced forces over the cutting edges while still permitting the desired arc of cartridge motion, the pivot axis P could be located on or above a plane through at least two cutting edges of the blades in an unloaded (at-rest) condition (which corresponds to a raised position for resiliently moving blades) and at or forward of a location approximately midway between the functional skin engaging surfaces of cap member 2 and guard member 14 (where loading occurs on a distributed area as the cap or guard, reference is considered from the midpoint of the respective skin engaging surface). Locating the pivot axis P at the plane through cutting edges and substantially close to the midpoint between the cap and guard contributes to evenly balancing the shaving forces applied to the cutting edges and advantageously maintaining all the shaving elements, namely the guard, the cap and the blade members, on the skin surface during a shaving operation.

In the embodiment of FIG. 5, razor blade assembly 10' has an at rest position at which it is biased upwardly (tilted forward). This provides a lower effective angle of the blades to the face when the face is first contacted and limits rotation to only the rearward angular direction. The skin being shaved is first contacted by the cap surface; then shaving forces orient assembly 10' to rotate it to a good shaving angle and orientation. (In common cases, the position could be one rotated less than is shown in FIG. 10.) When so upwardly biased, the blade edges are not initially normal to the razor handle. The angle at which the blades are initially presented to the face is lower, with the effect that there is more comfort initially and less chatter results. Apex 56 could be moved to a location between the forward position (as in FIG. 5) and the neutral position (shown for apex 52 in FIG. 3), providing a small amount of forward pivot and a much larger amount of rearward pivot. Neutral positioning or upwardly biased produce similar shaving results.

Figure 6:
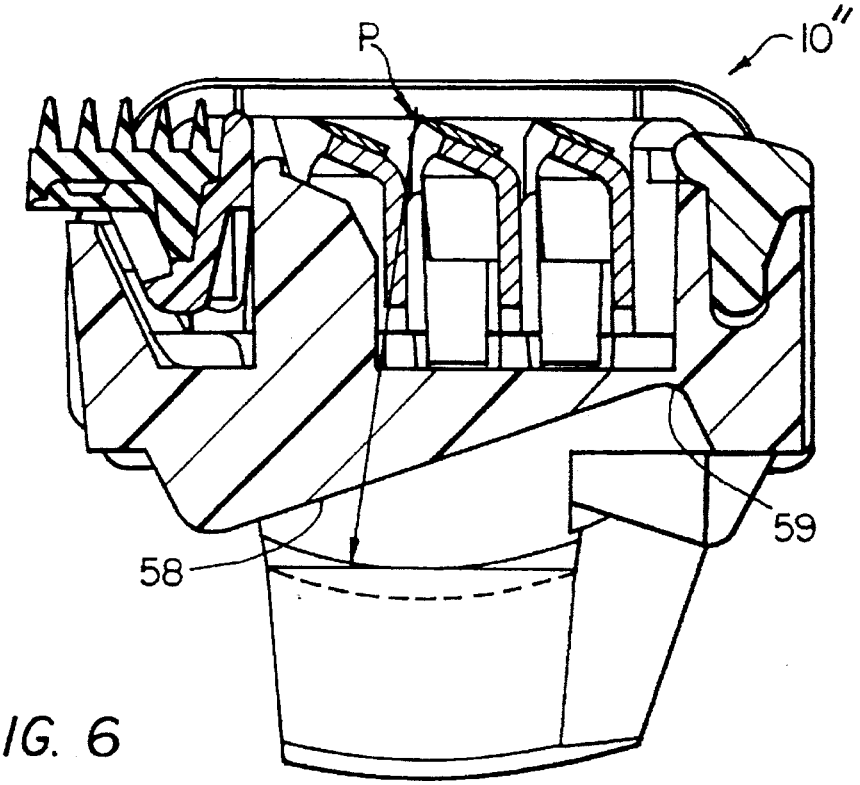
FIG. 6 is a vertical partial sectional view, taken at 6—6 of FIG. 2, of an another alternative embodiment of the FIG. 1 razor blade assembly.
Figure 7:
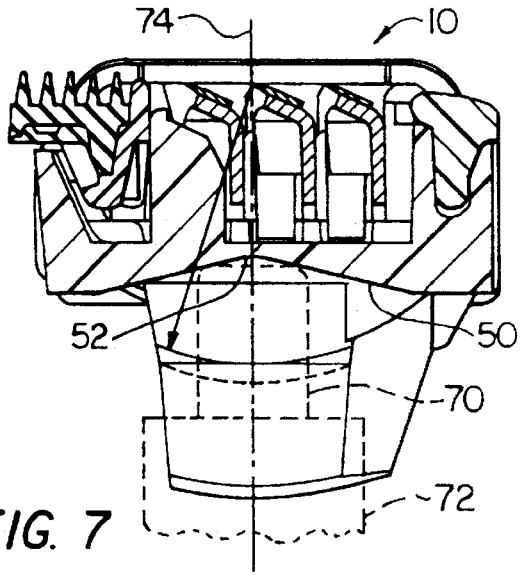
FIG. 7 is a vertical sectional view of the FIG. 3 razor blade assembly with portions of a handle and its cam follower shown in phantom in an at-rest position.

Alternatively, in the embodiment of FIG. 6, razor blade assembly 10" has a cam surface 58 with apex 59 located at the rear end thereof but otherwise has the same structure as assembly 10 or 10'. When mounted onto the handle, assembly 10" has an at-rest position having an opposite incline than that shown in FIG. 9. This is referred to as "downwardly biased" (tilted rearward) in its at rest position. In this case the blade assembly could only be rotated upward (counter clockwise in FIG. 9). In this case the guard contacts the face first and one gets the feel of the guard stretching the skin before shaving. While there would be a higher initial blade angle, the guard would provide shielding of the blades. It may also be desirable to move the apex to a location between the rearward position (as in FIG. 6) and the neutral position (apex 52 in FIG. 3), to provide a partially downwardly biased initial orientation. Applicant believes that biased down would produce similar shaving results to neutral positioning.

Other embodiments of the invention are within the scope of the following claims.

What is claimed is:

1. A razor blade assembly for mounting on a handle having a handle pivoting connecting structure, said assembly comprising a housing having a guard member at the front thereof, a cap structure at the rear thereof, a blade mounting portion between the guard member and the cap structure, upper surfaces at sides of the blade mounting portion, arcuate bearing surfaces below the blade mounting portion that slidably engage said handle pivoting connecting structure and have radii of curvature so as to provide pivotal mounting on said handle about a pivot axis located above said arcuate bearing surfaces, and first, second, and third blade members mounted in said blade mounting portion, said first blade member being mounted nearest the guard member and the third blade member being mounted nearest the cap structure, said first, second, and third blade members having respective first, second, and third leading edges generally directed toward said guard member and arranged to sequentially contact skin of a surface being shaved during a shaving operation, said leading edges in an unloaded position being lower than said upper surfaces, and said pivot axis being located in a region defined by a boundary extending from the first leading edge to the second leading edge when both are in the unloaded position, extending upward and rearward from the second leading edge to a position slightly above the upper surfaces of the housing at a location in front of the third leading edge, extending along and slightly above the upper surfaces of the housing to a position in front of the first leading edge, extending downward and forward to a location within the guard member below and forward of the first leading edge, and extending from the location within the guard member upward and rearward to the first leading edge.

2. The razor blade assembly of claim 1 wherein said pivot axis is located at or below said upper surfaces of said housing so that said razor blade assembly rotates through an arc of travel of at least about 40° about said pivot axis and relative to an imaginary arcuate extension of said arcuate bearing surfaces without said arcuate extension intersecting said housing.

3. The razor blade assembly of claim 2 wherein said region does not extend forward beyond a location midway between said first and second leading edges and does not extend rearward beyond a location midway between said second and third leading edges and does not extend above a location halfway between the leading edges and said upper surfaces at sides of said housing.

4. The razor blade assembly of claim 2 wherein said pivot axis is located at the second leading edge.

5. The razor blade assembly of claim 1 wherein said blade members are resiliently mounted in said blade mounting portion for movement from raised unloaded positions to lowered positions in response to forces encountered during shaving.

6. The razor blade assembly of claim 1 wherein at least two of the leading edges are sharpened cutting edges.

7. The razor blade assembly of claim 6 wherein the three leading edges are sharpened cutting edges.

8. The razor blade assembly of claim 1 wherein said region does not extend in front of said first leading edge.

9. The razor blade assembly of claim 1 wherein said region does not extend behind said second leading edge nor below said boundary extending from said first leading edge to said second leading edge when both are in the unloaded position.

10. The razor blade assembly of claim 1 wherein said pivot axis is located at or above a plane through at least two said leading edges in the unloaded position and at or forward of a position midway between skin engaging surfaces of said guard member and said cap structure.

11. The razor blade assembly of claim 1 further comprising clips at sides of said housing that retain said blade members on said housing.

12. The razor blade assembly of claim 1 wherein each said blade leading edge member is mounted on an L-shaped base and platform member.

13. The razor blade assembly of claim 1 wherein said pivot axis is in the region between said first and second leading edges and said upper surfaces of the housing thereabove.

14. The razor blade assembly of claim 1 wherein said pivot axis is located at the second leading edge.

15. The razor blade assembly of claim 1 wherein said arcuate bearing surfaces have a constant radius of curvature.

16. The razor blade assembly of claim 1 wherein said housing has stop surfaces interacting with said pivoting connecting structure of said handle to provide forward and rearward pivot stop positions.

17. The razor blade assembly of claim 1 wherein said guard member has upwardly extending ribs with tips located above a plane passing through said leading edges in the unloaded position.

18. The razor blade assembly of claim 17 wherein said tips are about halfway between said plane passing through said leading edges and a plane passing through said upper surfaces.

19. The razor blade assembly of claim 1 wherein said cap structure further comprises a lubricating strip member.

20. The razor blade assembly of claim 1 wherein said arcuate bearing surfaces have radii of curvature less than about 6 mm.

21. The razor blade assembly of claim 20 wherein said arcuate bearing surfaces have radii of curvature greater than about 4 mm.

22. The razor blade assembly of claim 1 wherein said arcuate bearing surfaces further comprise curved undersurfaces of said housing and opposing curved rails, said rails depending from said housing below said blade mounting portion.

23. The razor blade assembly of claim 1 wherein said handle further comprises a spring-biased cam follower and said arcuate bearing surfaces further provide for movement along an arc between a forward pivot stop position and a rearward pivot stop position, the position midway between said forward and rearward pivot stop positions being a midway position, said housing further comprising a cam surface having an apex located relative to said arcuate bearing surfaces to provide an at-rest position at a location other than said midway position and to permit resilient movement away from said at-rest position against spring bias force of said cam follower in response to pivotal forces encountered during shaving.

24. A razor blade assembly for mounting on a handle having a handle pivoting connecting structure, said assembly comprising a housing having a guard member at the front thereof for engaging skin, a cap structure at the rear thereof for engaging skin, a blade mounting portion between the guard member and the cap structure, upper surfaces at sides of the blade mounting portion, arcuate bearing surfaces below the blade mounting portion that slidably engage said handle pivoting connecting structure and have radii of curvature so as to provide pivotal mounting on said handle about a pivot axis, and first, second, and third blade members mounted in said blade mounting portion, said first blade member being mounted nearest the guard member and the third blade member being mounted nearest the cap structure, said first, second, and third blade members having respective first, second, and third leading edges generally directed toward said guard member and arranged to sequentially contact skin of a surface being shaved during a shaving operation, said leading edges in an unloaded position being lower than said upper surfaces, and said pivot axis being located in a region defined by a boundary extending at or above a plane through at least two said leading edges in the unloaded position and at or forward of a position midway between skin engaging surfaces of said guard member and said cap structure.

25. The razor blade assembly of claim 24 wherein said razor blade assembly rotates through an arc of travel of at least about 40° about said pivot axis and relative to an imaginary arcuate extension of said arcuate bearing surfaces without said arcuate extension intersecting said housing.

26. The razor blade assembly of claim 24 wherein said pivot axis is located substantially at the midway position.

27. The razor blade assembly of claim 26 wherein said pivot axis is located at the second leading edge.

28. The razor blade assembly of claim 24 wherein said blade members are resiliently mounted in said blade mounting portion for movement from raised unloaded positions to lowered positions in response to forces encountered during shaving.

29. The razor blade assembly of claim 24 wherein at least two of the leading edges are sharpened cutting edges.

30. The razor blade assembly of claim 24 wherein said cap structure further comprises a lubricating strip member.

31. The razor blade assembly of claim 24 wherein said arcuate bearing surfaces have radii of curvature less than about 6 mm.

32. The razor blade assembly of claim 31 wherein said arcuate bearing surfaces have radii of curvature greater than about 4 mm.

33. The razor blade assembly of claim 24 wherein said arcuate bearing surfaces further comprise curved undersurfaces of said housing and opposing curved rails, said rails depending from said housing below said blade mounting portion.

34. A razor blade assembly for mounting on a handle having a handle pivotal connecting structure and a spring-biased cam follower, said assembly comprising a housing having a guard portion at the front thereof, a cap portion at the rear thereof, a blade member mounting portion between the guard portion and the cap portion, and arcuate bearing surfaces below said blade member mounting portion that slidably engage said handle pivotal connecting structure and have radii of curvature so as to provide pivotal mounting about a pivot axis located above said arcuate bearing surfaces for movement along an arc between a forward pivot stop position and a rearward pivot stop position, the position midway between said forward and rearward pivot stop positions being a midway position, said housing having a cam surface having an apex located relative to said arcuate bearing surfaces to provide an at-rest position at a location other than said midway position and to permit resilient movement away from said at-rest position against spring bias force of said cam follower in response to pivotal forces encountered during shaving, and one or more blade members mounted in said blade member mounting portion.

35. The razor blade assembly of claim 34 wherein said cam surface further comprises two mutually inclined surfaces receiving said cam follower therebetween, said mutually inclined surfaces intersecting at said apex.

36. The razor blade assembly of claim 34 wherein said arcuate bearing surfaces further comprise curved undersurfaces of said housing and opposing curved rails, said rails depending from said housing below said blade member mounting portion.

37. The razor blade assembly of claim 34 wherein said arcuate bearing surfaces have radii of curvature less than about 6 mm.

38. The razor blade assembly of claim 37 wherein said arcuate bearing surfaces have radii of curvature greater than about 4 mm.

39. The razor blade assembly of claim 34 wherein the housing further comprises upper surfaces at sides of the blade member mounting portion and there are first, second, and third blade members having respective first, second, and third cutting edges generally directed toward said guard portion and arranged to sequentially contact skin of a surface being shaved during shaving, said cutting edges in an unloaded position being at or lower than said pivot axis, said first blade member being mounted proximate the guard portion and said third blade member being mounted proximate the cap portion, said pivot axis being located in a region defined by a boundary extending from the first cutting edge to the second cutting edge when both are in the unloaded position, extending upward and rearward from the second cutting edge to a position slightly above the upper surface of the housing at a location in front of the third cutting edge, extending along and slightly above the upper surface of the housing to a position in front of the first blade member, extending downward and forward to a location within the guard portion below and forward of the first cutting edge, and extending from the location within the guard portion upward and rearward to the first cutting edge.

40. The razor blade assembly of claim 39 wherein the first, second and third blade members are resiliently mounted in said blade member mounting portion for movement between said unloaded position to lowered positions in response to forces encountered during shaving.

41. The razor blade assembly of claim 34 wherein said apex is located near the front of said housing, whereby said razor blade assembly has a biased forward at-rest position.

42. The razor blade assembly of claim 34 wherein said apex is provided near the rear of said housing, whereby said razor blade assembly has a biased rearward at-rest position.

43. The razor blade assembly of claim 34 wherein said apex is located to provide an amount of forward pivoting and a greater amount of rearward pivoting.

44. The razor blade assembly of claim 34 wherein said apex is located to provide an amount of forward pivoting and a lesser amount of rearward pivoting.

* * * * *